United States Patent [19]

Behnke

[11] 4,230,491

[45] Oct. 28, 1980

[54] INTERNAL COMBUSTION ENGINE TAPPET COMPRISING A SINTERED POWDERED METAL WEAR RESISTANT COMPOSITION

[75] Inventor: Robert C. Behnke, Wheaton, Ill.

[73] Assignee: Stanadyne, Inc., Windsor, Conn.

[21] Appl. No.: 1,910

[22] Filed: Jan. 8, 1979

Related U.S. Application Data

[63] Continuation-in-part of Ser. No. 820,723, Aug. 1, 1977, abandoned.

[51] Int. Cl.[2] ..... C22C 38/12; C22C 38/14; C22C 38/18; F01L 1/14

[52] U.S. Cl. ..... 75/243; 75/244; 75/246; 123/90.51; 428/566

[58] Field of Search ..... 75/243, 244, 246; 428/566; 123/90.51

[56] References Cited

U.S. PATENT DOCUMENTS 3,698,877 10/1972 Motoyoshi ..... 75/243

*Primary Examiner*—Richard E. Schafer

*Attorney, Agent, or Firm*—Kinzer, Plyer, Dorn & McEachran

[57] ABSTRACT

An internal combustion engine tappet comprising a sintered powdered metal wear resistant composition having a matrix formed from iron powder, carbon in the range of 0.50–1.0% by weight, and a ferroalloy powder with a mesh size of +50–325 acting as a nucleus for diffusion of the alloying metal into the surrounding iron particles. The alloying metal in the composition is in the range of 1–10% by weight and is selected from the group consisting of chromium, titanium, boron, vanadium, columbium, molybdenum, tantalum and tungsten. The iron, carbon and ferroalloy are briquetted at a pressure of 40–60 tons/sq.in. and sintered, in solid phase, at a temperature of 2000°–2100° F. in a reducing atmosphere. The resulting product is heterogeneous and has hard ferroalloy nuclei and interconnected porosity with a density at the tappet wear surface of approximately 6.8–7.0 gm/cc.

5 Claims, 1 Drawing Figure

POWDERED METAL CAMFACE
500X
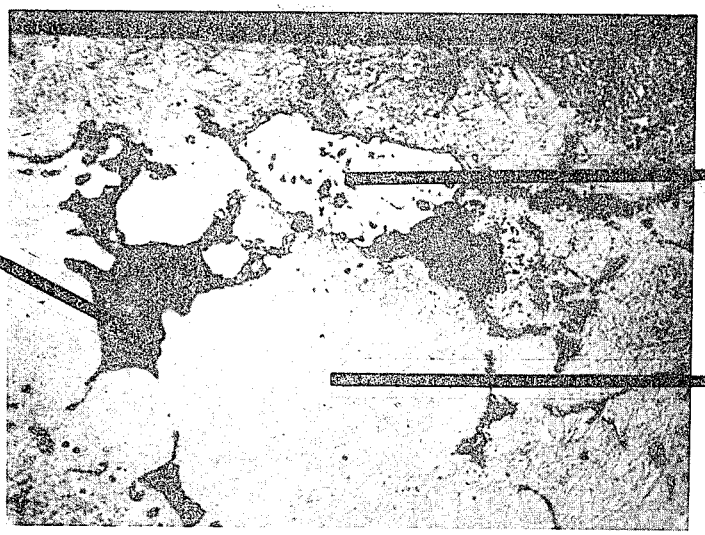
HARDENABLE IRON CAMFACE
500X
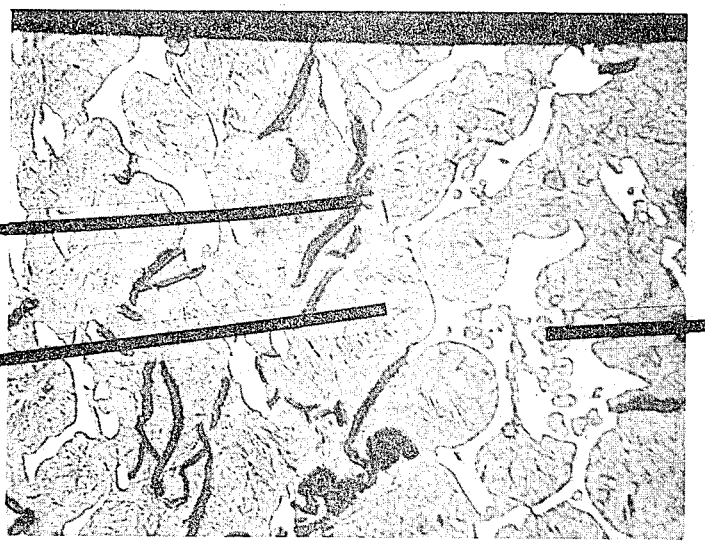

INTERNAL COMBUSTION ENGINE TAPPET COMPRISING A SINTERED POWDERED METAL WEAR RESISTANT COMPOSITION

SUMMARY OF THE INVENTION

This invention is a continuation-in-part of my copending application Ser. No. 820,723, filed Aug. 1, 1977 now abandoned.

The present invention relates to an internal combustion engine tappet comprising a powdered metal wear resistant composition which has the characteristics of heat treated hardenable iron.

One purpose of the invention is a wear resistant composition formed of powdered metal which can be applied in sensitive wear applications where heat treated hardenable iron has heretofore been the standard material.

Another purpose is a composition of the type described utilizing a ferroalloy in which the alloying metal is selected from the group consisting of chromium, titanium, boron, vanadium, columbium, molybdenum, tantalum and tungsten.

Another purpose is a powdered metal wear resistant composition of the type described in which the alloying metal is in the range of 1-10% by weight.

Another purpose is a sintered powdered metal wear resistant composition of the type described in which the material remains in solid phase during the sintering process.

Another purpose is a sintered powdered metal wear resistant composition of the type described in which the iron, carbon and ferroalloy are briquetted at prescribed pressures and sintered, in solid phase, in a reducing atmosphere which includes the combination of carbon monoxide and hydrogen in the range of 55-80%.

Another purpose is a composition of the type described in which the sintering process takes place in an endothermic atmosphere.

Another purpose is a powdered metal wear resistant composition which is sintered in a disassociated ammonia atmosphere.

Another purpose is a sintered powdered metal wear resistant tappet which can be used on steel camshafts as a replacement for chilled iron tappets.

Another purpose is a sintered powdered metal wear resistant composition which provides hard particles, interconnected porosity and a hardened steel matrix.

Another purpose is a sintered powdered metal wear resistant composition of the type described which is hardened and tempered to an apparent hardness of Rockwell C 35-55.

Another purpose is an internal combustion engine tappet comprising a sintered powdered metal wear resistant composition of the type described having a density at the wear surface of approximately 6.8-7.0 gm/cc.

Other purposes will appear in the ensuing specification, drawing and claims.

BRIEF DESCRIPTION OF THE DRAWING

The invention is illustrated diagrammatically in the following photomicrographs taken at 500 times magnification and showing the structure of heat treated hardenable iron and a heat treated sintered powdered metal wear resistant composition produced in accordance with the described specification.

DESCRIPTION OF THE PREFERRED EMBODIMENT

Heat treated hardenable iron is used in a number of critical wear components in vehicle engines, specifically: tappet bodies, camshafts, rocker followers, and distributor drive gears. These applications involve high contact stress, sliding type loading, and marginal lubrication. Such severe conditions require a material to possess a high resistance to scuffing (welding or adhesive wear), a controlled normal wear (abrasion and plastic deformation), and a realistic endurance limit (pitting and metal fatigue). In addition, the part in question must be compatible with its mating component under all service conditions.

Hardenable iron has three major constituents: massive, hard, non-metallic carbides; flakes of soft, amorphous graphite; and a hardened steel-like matrix. These three constituents must be controlled within narrow limits during casting and heat treatment. This places certain restrictions on the chemical analysis, melting, molding and heat treatment of the casting. Controlled processing produces an equilibrium between the carbide and graphite, which are dispersed at random throughout the steel matrix, as shown in the lower photomicrograph. The density and orientation of the carbide/graphite are in turn related to the volume, size and orientation of the original austenite dendrites formed during solidification. The density of the carbides is maintained at a specific minimum level for wear resistance, and a high level of acicular type carbide is required. The residual graphite is present as flakes. These flakes are discontinuities in the matrix, and they fracture during service, leaving small cavities which entrap lubricant. The matrix is hardened and tempered to produce a high compressive strength and hardness. This produces the strong, tough matrix which holds the carbide and graphite.

The present invention provides a sintered powdered metal wear resistant composition which replaces the described heat treated hardenable iron. The powdered metal contains the three basic elements found in hardenable iron: hard particles, interconnected porosity and a hardened and tempered steel matrix. The resulting product is heterogeneous rather than homogeneous as a heterogeneous product has interconnected porosity useful in providing lubrication at the wear face of the tappet. The wear resistant material may be present as a layer on the contact surface, for example 1/32-$\frac{1}{8}$ inch in thickness, backed with a low alloy iron, or it may be used to make the entire part.

The composition is formed from iron powder, carbon in the range of 0.50-1.0% by weight and a ferroalloy powder. The carbon may be inserted as graphite, or it may be added in other ways. The alloying metal in the composition is in the range of 1-10% by weight and is selected from the group consisting of chromium, titanium, boron, vanadium, columbium, molybdenum, tantalum and tungsten. The described materials are briquetted at a pressure of 40-60 tons/sq.in. and sintered, in solid phase, at a temperature of 2000°-2100° F. in a reducing atmosphere. The resultant product has a density at the wear surface of 6.8-7.0 gm/cc. The sintering step in the process may be for a period of 15-60 minutes, with 30 minutes being a preferred time period. The reducing atmosphere may be endothermic (40% hydrogen, 40% nitrogen and 20% carbon monoxide) or disassociated ammonia (75% hydrogen, 25% nitrogen). Although the reducing atmosphere may vary, it is preferred to include the combination of hydrogen and carbon monoxide in the range of 55–80%.

The sintered product is heat treated at about 1600° F. for a period of 1½ hours in an endothermic atmosphere to which has been added natural gas and ammonia. The dew point of the gas is controlled so as to eliminate any loss of carbon. Following the heat treatment the product is quenched in oil having a temperature in the range of 185°–215° F. with subsequent tempering at 400° F. for one hour.

The ferroalloy used may be a commercial product having a +50–325 mesh size and containing low carbon and low silicon. The alloy content of the feroalloy may vary as follows:

Chromium:65–75%
Titanium:37–47%
Vanadium49–59%
Boron:14–24%
Columbium:60–70%
Tungsten:78–88%
Molybdenum:60–64%
Tantalum:48–52%

Preferably the iron powder has a high compressibility with a mesh size of +80. Although the alloy content of the composition may be in the range of 1–10%, 2½% has been found to be a preferred amount.

The ferroalloy particles function as a nucleus for the diffusion of the alloy into the surrounding particles of iron and carbon. This results in a gradient of intermetallic phases around each ferroalloy nucleus being formed during the sintering process. The ferroalloy nuclei are dispersed throughout the powder blend. They are hard and macroscopic in size, ranging up to 0.010 inch in diameter. These hard particles are keyed into the structure like the islands of carbides in hardenable iron as shown in the drawing and act as bridges to carry the imposed load. The powdered metal has interconnected porosity, and these voids acts as reservoirs for the lubricants similiar to the graphite in hardenable iron, thereby supplying oil on demand similar to a self-lubricating bearing. The matrix is a high carbon ferrous powder with sufficient hardenability to develop a semi-martensitic matrix when heat treated in a carbonitriding atmosphere at 1600° F., quenched oil, and tempered at 400° F.

The drawing illustrates the similarity between the described interconnected porosity and the soft graphite flakes of hardenable iron. The hardened steel matrix is present in both the powdered metal composition and the hardenable iron material. In like manner, the hard ferrochrome nucleus functions as and appears similar to the hard carbide particles in hardenable iron.

The resultant structure has a high resistance to scuffing, compares with hardenable iron for wear and endurance, and shows a high degree of compatibility with mating components. The mating components can be carburized, hardened or induction hardened steel, as well as heat treated hardenable iron.

It is important in the sintering process that the liquid phase not be reached. By maintaining a solid phase during the sintering operation, it is possible to have substantially less carbon content in the composition and also to have a sintering process which operates over a shorter period of time at substantially lower temperatures. This of course provides for a process which can function at much less cost than one which requires a liquid phase sinter.

In U.S. Pat. No. 3,850,583, because of the extreme high titanium content in the ferroalloy, 70%, the composition goes into liquid phase during sintering at a temperature of approximately 2100° F.

In U.S. Pat. No. 3,782,930, a mixture of cast iron, graphite, carbon and ferrotitanium in which the titanium is present as titanium carbide, because of an extremely high carbon content, 1–4.5%, the composition goes into liquid phase during sintering.

In U.S. Pat. No. 3,937,630 there is a liquid phase sinter and extremely high carbon content, 1.5–6%.

U.S. Pat. No. 3,950,165 provides for liquid phase sintering at a temperature of 2552° F. for five hours which is excessive both in temperature and duration and therefore basically an uneconomical process.

U.S. Pat. No. 3,698,877 discloses a powdered metal composition, not for use as a tappet, and having a density above 7.2 gm/cc. The end product in such patent is homogeneous, not heterogeneous, and does not therefore provide the interconnected porosity described above which is important in entrapping and providing lubricant at the wear surface.

Following are specific examples of wear resistant compositions of the type described which have been satisfactorily tested for the specific use set forth above:

EXAMPLE 1

A mixture of iron powder having a mesh size of +80, 0.9% carbon by weight, and a ferrochromium alloy in an amount to provide 2.5% chromium by weight was briquetted at a pressure of between 40–60 tons/sq.in. and sintered in a disassociated ammonia atmosphere for 30 minutes at a temperature of 2050° F. The composition was used to form a heat treated tappet body which compared favorably with hardenable iron relative to the wear characteristics and properties described above.

EXAMPLE 2

A mixture of iron powder having a mesh size of +80, 0.9% carbon by weight, and a ferrovanadium alloy in an amount to provide 2.5% vanadium by weight was briquetted at a pressure of between 40–60 tons/sq.in. and sintered in an endothermic atmosphere for 15 minutes at a temperature of 2050° F. The composition was used to form a heat treated tappet body which compared favorably with hardenable iron relative to the wear characteristics and properties described above.

EXAMPLE 3

A mixture of iron powder having a mesh size of +80, 0.9% carbon by weight, and a ferrotitanium alloy in an amount to provide 2.5% titanium by weight was briquetted at a pressure of between 40–60 tons/sq.in. and sintered in an endothermic atmosphere for 30 minutes at a temperature of 2050° F. The composition was used to form a heat treated tappet body which compared favorably with hardenable iron relative to the wear characteristics and properties described above.

EXAMPLE 4

A mixture of iron powder with a mesh size of +80, 0.9% carbon by weight, and a ferroboron alloy in an amount to provide 2.5% by weight was briquetted at a pressure of between 40–60 tons/sq.in. and sintered in an endothermic atmosphere for 30 minutes at a temperature of 2050° F. The composition was used to form a heat treated tappet body which compared favorably with hardenable iron relative to the wear characteristics and properties described above.

Although the invention has been described in connection with vehicle engine components, it has wider application. Specifically, the described composition has use where similar wear conditions exist such as pump and transmission components.

Whereas the preferred form of the invention has been shown and described herein, it should be realized that there may be many modifications, substitutions and alterations thereto.

The embodiments of the invention in which an exclusive property or privilege is claimed are defined as follows:

1. An internal combustion engine tappet comprising a sintered powdered metal heat treated wear resistant composition having a matrix formed from iron powder, carbon in the range of 0.50–1.0% by weight, and a ferroalloy powder with a mesh size of +50–325 acting as a nucleus for diffusion of the alloying metal into the surrounding iron particles, the alloying metal in the composition being in the range of 1–10% by weight and being selected from the group consisting of chromium, titanium, boron, vanadium, columbium, molybdenum, tantalum and tungsten, the iron, carbon and ferroalloy being briquetted at a pressure of 40–60 tons/sq.in. and sintered, in solid phase, at a temperature of 2000°–2100° F. in a reducing atmosphere including the combination of carbon monoxide and hydrogen in the range of 55–80%, the resulting product being heterogeneous and having hard ferroalloy nuclei and interconnected porosity with a density at the wear surface of approximately 6.8–7.0 gm/cc.

2. The composition of claim 1 further characterized in that said alloying metal is approximately 2.5% by weight of the composition.

3. The composition of claim 1 further characterized in that said composition is sintered for a period of 15–60 minutes.

4. The composition of claim 1 further characterized in that said reducing atmosphere is endothermic.

5. The composition of claim 1 further characterized in that said reducing atmosphere includes approximately 75% hydrogen.

* * * * *